US006746617B2

(12) United States Patent
Radomyselski et al.

(10) Patent No.: US 6,746,617 B2
(45) Date of Patent: Jun. 8, 2004

(54) FABRIC TREATMENT COMPOSITION AND METHOD

(75) Inventors: Anna Vadimovna Radomyselski, Hamilton, OH (US); Paul Amaat Raymond Gerald France, West Chester, OH (US); Wilbur Thomas Woods, Cincinnati, OH (US)

(73) Assignee: Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/238,270

(22) Filed: Sep. 10, 2002

(65) Prior Publication Data

US 2003/0062507 A1 Apr. 3, 2003

Related U.S. Application Data

(60) Provisional application No. 60/318,389, filed on Sep. 10, 2001.

(51) Int. Cl.[7] ..... D06M 15/263

(52) U.S. Cl. ..... 252/8.91; 38/144; 427/393.2; 427/421; 427/429; 427/443.2; 510/513

(58) Field of Search ..... 252/8.91; 38/144; 427/393.2, 421, 429, 443.2; 510/513

(56) References Cited

U.S. PATENT DOCUMENTS

| | | | | |
|---|---|---|---|---|
| 4,102,824 | A | | 7/1978 | Mizutani et al. |
| 4,639,321 | A | | 1/1987 | Barrat et al. |
| 4,685,930 | A | | 8/1987 | Kasprzak et al. |
| 4,708,807 | A | | 11/1987 | Kemerer et al. |
| 5,057,240 | A | | 10/1991 | Madore et al. |
| 5,532,023 | A | * | 7/1996 | Vogel et al. ..... 427/8 |
| 5,573,695 | A | * | 11/1996 | Targosz ..... 252/8.91 |
| 5,705,562 | A | | 1/1998 | Hill et al. |
| 5,707,613 | A | | 1/1998 | Hill et al. |
| 5,865,852 | A | | 2/1999 | Berndt et al. |
| 5,876,510 | A | | 3/1999 | Kuemin et al. |
| 5,888,250 | A | | 3/1999 | Hayday et al. |
| 5,942,007 | A | | 8/1999 | Berndt et al. |
| 5,977,040 | A | | 11/1999 | Inada et al. |
| 5,985,810 | A | | 11/1999 | Inada et al. |
| 6,013,683 | A | | 1/2000 | Hill et al. |
| 6,042,617 | A | | 3/2000 | Berndt et al. |
| 6,042,618 | A | | 3/2000 | Berndt et al. |
| 6,056,789 | A | | 5/2000 | Berndt et al. |
| 6,059,845 | A | | 5/2000 | Berndt et al. |
| 6,060,546 | A | | 5/2000 | Powell et al. |
| 6,063,135 | A | | 5/2000 | Berndt et al. |
| 6,106,738 | A | * | 8/2000 | Woo et al. ..... 252/8.91 |
| 6,136,766 | A | | 10/2000 | Inada et al. |
| 6,156,074 | A | | 12/2000 | Hayday et al. |
| 6,177,399 | B1 | | 1/2001 | Mei et al. |
| 6,258,130 | B1 | | 7/2001 | Murphy et al. |
| 6,273,919 | B1 | | 8/2001 | Hayday et al. |
| 6,309,425 | B1 | | 10/2001 | Murphy et al. |
| 6,310,029 | B1 | | 10/2001 | Kilgour et al. |
| 6,313,079 | B1 | | 11/2001 | Murphy et al. |
| 6,368,359 | B1 | | 4/2002 | Perry et al. |
| 6,491,840 | B1 | * | 12/2002 | Frankenbach et al. ..... 252/8.91 |
| 6,495,057 | B1 | * | 12/2002 | Kasson et al. ..... 252/8.91 |
| 6,495,058 | B1 | * | 12/2002 | Frankenbach et al. ..... 252/8.91 |
| 6,503,413 | B2 | * | 1/2003 | Uchiyama et al. ..... 252/8.91 |
| 6,514,932 | B1 | * | 2/2003 | Hubesch et al. ..... 510/517 |
| 2001/0020308 | A1 | | 9/2001 | Murphy et al. |
| 2001/0034912 | A1 | | 11/2001 | Kilgour et al. |
| 2002/0004953 | A1 | | 1/2002 | Perry et al. |
| 2002/0115582 | A1 | | 8/2002 | Perry et al. |
| 2002/0174493 | A1 | | 11/2002 | Perry et al. |

FOREIGN PATENT DOCUMENTS

| | | | |
|---|---|---|---|
| DE | 37 39 711 | A1 | 6/1989 |
| EP | 0982 023 | A2 | 3/2000 |
| EP | 1 041 189 | A1 | 10/2000 |
| EP | 1 043 443 | A1 | 10/2000 |
| EP | 1092 803 | A1 | 4/2001 |
| JP | 2000-290689 | | 10/2000 |
| WO | WO96/15309 | | * 5/1996 |
| WO | WO 96/30583 | | 10/1996 |
| WO | WO 99/55816 | | 11/1999 |
| WO | WO 99/55951 | | 11/1999 |
| WO | WO 00/04221 | | 1/2000 |
| WO | WO 00/04222 | | 1/2000 |
| WO | WO 00/63340 | | 10/2000 |
| WO | WO 01/40567 | A1 | 6/2001 |
| WO | WO 01/61100 | A2 | 8/2001 |
| WO | WO 01/94678 | A1 | 12/2001 |
| WO | WO 01/94681 | A1 | 12/2001 |
| WO | WO 01/94684 | A1 | 12/2001 |
| WO | WO 02/97024 | | 5/2002 |
| WO | WO 02/46517 | A1 | 6/2002 |
| WO | WO 02/48447 | A1 | 6/2002 |
| WO | WO 02/50366 | A1 | 6/2002 |
| WO | WO 02/77356 | A1 | 10/2002 |

* cited by examiner

*Primary Examiner*—Anthony J. Green
(74) *Attorney, Agent, or Firm*—C. Brant Cook; Caroline Wei-Berk; Kim William Zarby

(57) ABSTRACT

Compositions and methods for wrinkle reduction in fabrics, including washable clothes, dry cleanable clothes, linens, bed clothes, draperies, window curtains, shower curtains, table linens, and the like requiring little, if any, pressing, ironing, and/or steaming are disclosed.

16 Claims, No Drawings

FABRIC TREATMENT COMPOSITION AND METHOD

RELATED APPLICATIONS

This application claims priority to U.S. Provisional Application Serial No. 60/318,389 filed Sep. 10, 2001.

FIELD OF THE INVENTION

The present invention relates to compositions and methods for wrinkle reduction in fabrics, including washable clothes, dry cleanable clothes, linens, bed clothes, draperies, window curtains, shower curtains, table linens, and the like requiring little, if any, pressing, ironing, and/or steaming are disclosed.

BACKGROUND OF THE INVENTION

Bending and creasing cause wrinkles in textile fabrics by placing an external portion of a yarn filament under tension while the internal portion of the yarn filament is under compression. With cotton fabrics particularly, the hydrogen bonding that occurs between the cellulose molecules contributes to maintaining the wrinkles. The wrinkling of fabric, particularly clothing and household fabrics, is therefore subject to the inherent tensional elastic deformation and recovery properties of the individual fibers that make up the yarn.

In order to reduce wrinkles and provide fabric articles with a presentable appearance, the articles must either be pressed or steamed. Both processes involve exposing the articles to heat in order to relax wrinkles. Both processes also require an implement, heat-up time, and manual exposure of the articles to heat. Pressing, ironing, and steaming are labor-intensive tasks that require time to conduct. This labor and time is in addition to any cleaning and/or refreshing steps that must be taken prior to re-wear of articles. Some consumers send articles to costly dry cleaning service providers for cleaning just to avoid the additional step of pressing, ironing, or steaming—even if the consumer is willing and able to clean the articles themselves.

Increasingly however, consumers are subjected to more hectic lives and, as a result, demand less labor-intensive and/or more cost efficient fabric care either in the home or from commercial service providers. This demand has increased the pressure on textile technologists to create products that sufficiently reduce wrinkles in fabrics, especially clothing and household fabrics, and to produce a presentable fabric appearance with the convenient application of these products.

Accordingly, there is a need for wrinkle control in fabrics, including washable clothes, dry cleanable clothes, linens, bed clothes, draperies, window curtains, shower curtains, table linens, and the like requiring little, if any, pressing, ironing, and/or steaming. A solution would be capable of being used on damp or dry clothing to relax wrinkles and give clothes a ready to wear or ready to use look that is demanded by today's hectic society.

SUMMARY OF THE INVENTION

The need is met by the present invention wherein compositions and methods for wrinkle reduction in fabrics, including washable clothes, dry cleanable clothes, linens, bed clothes, draperies, window curtains, shower curtains, table linens, and the like requiring little, if any, pressing, ironing, and/or steaming are disclosed. The present invention is suitable for application on damp or dry clothing to relax wrinkles and give clothes a ready to wear or ready to use look that is demanded by today's hectic society. The present invention comprises both compositions and methods for reducing wrinkles in fabrics.

In one embodiment, the present invention provides a fabric treatment composition comprising:

(a) an effective amount, in one embodiment from about 0.001% to no greater than about 25% by weight of the composition, of a polymer to control wrinkles in fabric articles;

(b) a co-solvent; and (c) a carrier.

In another embodiment, the present invention provides a method comprising the steps of:

(a) applying a fabric treating composition of the present invention;

(b) applying a fabric cleaning composition comprising a lipophilic fluid; and (c) removing mechanically at least a portion of the fabric cleaning composition.

Accordingly, the present invention provides compositions and methods employing such compositions that reduce and/or control wrinkles in fabric articles.

DETAILED DESCRIPTION OF THE INVENTION

Definitions

The term "fabric article" used herein is intended to mean any article that is customarily cleaned in a conventional laundry process or in a dry cleaning process. As such the term encompasses articles of clothing, linen, drapery, and clothing accessories. The term also encompasses other items made in whole or in part of fabric, such as tote bags, furniture covers, tarpaulins and the like.

The term "spraying" and/or "spray" used herein encompasses a means for applying droplets of the cleaning fluid to a fabric article. Typically, the droplets may range in average droplet size tram about 100 $\mu$m to about 1000 $\mu$m, preferably from about 50 $\mu$m to about 1000 $\mu$m. As used herein, the term also encompasses "mist" and/or "misting" and "fog" and/or "fogging", those terms being subclasses of "spray" and/or "spraying" and are on the small side of the average droplet size.

The "spray" may be made by any suitable means known to those in the art. Nonlimiting examples include passing the cleaning fluid through nozzles, atomizers, ultrasonic devices and the like.

The term "lipophilic fluid" used herein is intended to mean any non-aqueous fluid capable of removing sebum, as described in more detail hereinbelow.

The term "textile treatment liquid" used herein is intended to mean any liquid, aqueous or non-aqueous, suitable for cleaning, conditioning or sizing of fabrics.

The lipophilic fluid and the textile treatment liquid will be referred to generically as the "cleaning fluid", although it should be understood that the term encompasses uses other than cleaning, such as conditioning and sizing. Furthermore, optional adjunct ingredients such as surfactants, bleaches, and the like may be added to the "cleaning fluid". That is, adjuncts may be optionally combined with the lipophilic fluid and/or the textile treatment liquid. These optional adjunct ingredients are described in more detail hereinbelow.

The term "cleaning composition" and/or "treating composition" used herein are intended to mean any lipophilic fluid-containing composition that comes into direct contact with fabric articles to be cleaned. It should be understood that the term encompasses uses other than cleaning, such as conditioning and sizing.

The phrase "dry weight of a fabric article" as used herein means the weight of a fabric article that has no intentionally added fluid weight.

The phrase "absorption capacity of a fabric article" as used herein means the maximum quantity of fluid that can be taken in and retained by a fabric article in its pores and interstices. Absorption capacity of a fabric article is measured in accordance with the following Test Protocol for Measuring Absorption Capacity of a Fabric Article.

Test Protocol for Measuring the Absorption Capacity of a Fabric Article

Step 1: Rinse and dry a reservoir or other container into which a lipophilic fluid will be added. The reservoir is cleaned to free it from all extraneous matter, particularly soaps, detergents and wetting agents.

Step 2: Weigh a "dry" fabric article to be tested to obtain the "dry" fabric article's weight.

Step 3: Pour 2 L of a lipophilic fluid at ~20 C. into the reservoir.

Step 4: Place fabric article from Step 2 into the lipophilic fluid-containing reservoir.

Step 5: Agitate the fabric article within the reservoir to ensure no air pockets are left inside the fabric article and it is thoroughly wetted with the lipophilic fluid.

Step 6: Remove the fabric article from the lipophilic fluid-containing reservoir.

Step 7: Unfold the fabric article, if necessary, so that there is no contact between same or opposite fabric article surfaces.

Step 8: Let the fabric article from Step 7 drip until the drop frequency does not exceed 1 drop/sec.

Step 9: Weigh the "wet" fabric article from Step 8 to obtain the "wet" fabric article's weight.

Step 10: Calculate the amount of lipophilic fluid absorbed for the fabric article using the equation below.

$$FA=(W-D)/D*100$$

where:

FA=fluid absorbed, % (i.e., the absorption capacity of the fabric article in terms of % by dry weight of the fabric article)

W=wet specimen weight, g

D=initial specimen weight, g

By the term "non-immersive" it is meant that essentially all of the fluid is in intimate contact with the fabric articles. There is, at most, minimal amounts of "free" wash liquor. It is unlike an "immersive" process where the washing fluid is a bath in which the fabric articles are either submerged, as in a conventional vertical axis washing machine, or plunged into, as in a conventional horizontal washing machine. The term "non-immersive" is defined in greater detail according to the following Test Protocol for Non-Immersive Processes. A process in which a fabric article is contacted by a fluid is a non-immersive process when the following Test Protocol is satisfied.

Test Protocol for Non-Immersive Processes

Step 1: Determine absorption capacity of a fabric specimen using Test Protocol for Measuring Absorption Capacity of a Fabric Article, described above.

Step 2: Subject a fabric article to a fluid contacting process such that a quantity of the fluid contacts the fabric article.

Step 3: Place a dry fabric specimen from Step 1 in proximity to the fabric article of Step 2 and move/agitate/tumble the fabric article and fabric specimen such that fluid transfer from the fabric article to the fabric specimen takes place (the fabric article and fabric specimen must achieve the same saturation level).

Step 4: Weigh the fabric specimen from Step 3.

Step 5: Calculate the fluid absorbed by the fabric specimen using the following equation:

$$FA=(W-D)/D*100$$

where:

FA=fluid absorbed, %

W=wet specimen weight, g

D=initial specimen weight, g

Step 6: Compare the fluid absorbed by the fabric specimen with the absorption capacity of the fabric specimen. The process is non-immersive if the fluid absorbed by the fabric specimen is less than about 0.8 of the absorption capacity of the fabric specimen.

Vapor Permeability Test Protocol

The purpose of this test is to determine the ability of water vapor to transport through fabric.

1. Cut test fabric to 4 inches square.
2. Place the fabric over a small jar filled with water. The fabric should be out-side facing up. Secure the fabric with a band.,
3. Record the weight of the jar with fabric and water and band (initial wt.)
4. Allow the jar to stand over-night (~16 hrs.) at ambient temperatures
5. Repeat this test with no less than 3-replicates for each test condition.
6. Next day, weigh the jars and determine the % weight loss from the initial weight.

Even though the present invention is discussed in detail with respect to non-immersive fabric treating processes, immersive fabric treating processes are within the broad scope of the present invention. By the term "immersive" as used herein it is meant that excess, free-standing (i.e., above the absorption capacity of the fabric articles) cleaning composition is in contact with the fabric articles.

Pilling and Abrasion Test Method

The abrasion test used in this invention is described in ASTM D4966 and in the Nu-Martindale Abrasion and Pilling Tester Operator's Guide as supplied by the Manufacturer Martindale Compositions The present invention relates to lipophilic wrinkle reducing, removing and/or controlling compositions comprising a polymer containing carboxylic acid moieties, that is preferably stable, well-dispersed opaque, translucent, or clear suspensions, dispersions, or solutions with the dispersed or solubilized polymer particulates being very small in particle size, that distribute evenly from dispensers to prevent staining. Specified pH solutions are acceptable if these have the low viscosity that is necessary to provide acceptable dispensing. The present invention also relates to preferred compositions containing, in addition to the essential carboxylic acid containing polymer and carrier, optional, but preferred ingredients, e.g. polyalkylene oxide polysiloxane, fabric care polysaccharides, odor control components, co-solvent, and minors such as perfume and preservative, adjusted to a specified pH to provide both good dispensing properties and improved stability to shear forces (e.g. stirring during processing or shaking that occurs during transit). The present invention further relates to methods of formulating such compositions, as well as fabric wrinkle control methods and articles of manufacture that comprise such fabric wrinkle controlling compositions. The fabric wrinkle control compositions typically comprise:

(a) at least an effective amount to control wrinkles in fabric of a polymer preferably selected from the group of polymers comprising carboxylic acid moieties that can be suspended, dispersed or solubilized at a specified pH range to produce a lipophilic solution with a viscosity lower than the viscosity of that polymer composition at a pH above the specified pH range and with the viscosity of the solution preferably below about 20 centipoise ("cP"), more preferably below about 15 cP, even more preferably below about 12 cP, even more preferably below about 10 cP, still more preferably below about 7 cP and most preferably below about 3 cP, with the polymer incorporated at a level that is at least about 0.001%, preferably at least about 0.01%, and more preferably at least about 0.05%, and still more preferably at least about 0.1% and even more preferably at least about 0.25% and most preferably at least about 0.5% and at a level of no greater than about 25%, more preferably no greater than about 10%, even more preferably no greater than about 7%, and still more preferably no greater than about 5% by weight of the usage composition; mixtures of polymers are also acceptable in the present composition; and (b) at least an effective amount of a co-solvent, preferably water, at a level that is at least about 0.001%, preferably at least about 0.01%, and more preferably at least about 0.05%, and still more preferably at least about 0.1% and even more preferably at least about 0.25% and most preferably at least about 0.5% and at a level of no greater than about 25%, more preferably no greater than about 10%; and, (c) at least an effective amount of a carrier, preferably lipophilic fluid.

The polymer compositions of the present invention can optionally further comprise silicone compounds and/or emulsions especially those compounds that impart lubricity and softness, as well as those that reduce surface tension. Non-limiting examples include silicones modified with alkylene oxide moieties compounds. Mixtures of silicones that provide desired benefits are also acceptable in the present composition. Another option is an effective amount of a supplemental wrinkle control agent selected from the group consisting essentially of (1) adjunct polymer (2) fabric care polysaccharides, (3) lithium salts, (4) fiber fabric lubricants, and (5) mixtures thereof. Other options include an effective amount of a supplemental surface tension control agent, an effective amount to soften fibers and/or polymer of hydrophilic plasticizer wrinkle control agent, an effective amount of odor control agent to absorb or reduce malodor, and/or an effective amount of perfume to provide olfactory effects. Yet another option is an effective amount of solubilized, water-soluble, anti-microbial preservative, preferably from about 0.0001% to about 0.5%, more preferably from about 0.0002% to about 0.2%, most preferably from about 0.0003% to about 0.1%, by weight of the composition.

The present compositions are preferably essentially free of materials that would soil or stain fabric under usage conditions, or preferably free of materials at a level that would soil or stain fabrics unacceptably under usage conditions. The present invention also relates to concentrated compositions, including liquid, fluid and solid forms of concentrated compositions that may be diluted to form compositions with the usage concentrations for use under usage conditions. It is preferred that the concentrated compositions be delivered in forms that rapidly and smoothly dissolve or disperse to the usage concentration The present invention also relates to combining the composition with a substrate and/or device capable of containing said composition for release at a desirable time in a fabric treatment process to create an article of manufacture. Such articles of manufacture can facilitate treatment of fabric articles and/or surfaces with said pH adjusted polymer compositions containing wrinkle control agent and other optional ingredients at a level that is effective, yet not discernible when dried on the surfaces of said fabric. The article of manufacture can operate in mechanical devices designed to alter the physical properties of articles and/or surfaces such as, but not limited to, a clothes dryer or mechanical devices designed to spray fabric care compositions on fabrics or clothes.

The present invention further relates to fabric wrinkle control methods and articles of manufacture that comprise the present pH adjusted polymer compositions in lipophilic fluid. The present articles of manufacture preferably comprise the present compositions incorporated into a container, preferably a spray dispenser, to facilitate the treatment of fabric surfaces with said polymer compositions comprising polymer and other optional ingredients at a level that is effective, yet is not discernible when dried on the surfaces. The spray dispenser can comprise a manually-activated or non-manually powered spray means and container containing the present compositions.

The present invention also relates to concentrated compositions, including liquids, solution, and solids (such as, but not limited to, granules and flakes), wherein the level of wrinkle control agent is typically at least about 1% preferably at least about 5%, more preferably at least about 10%, still more preferably at least about 30% and typically less than about 100%, preferably less than about 99%, more preferably less than about 95%, and even more preferably less than about 90%, by weight of the concentrated composition. The concentrated composition is typically diluted to form usage compositions, with usage concentrations of, e.g., from about 0.025% to about 25%, by weight of the usage composition, of wrinkle control active as given hereinabove. Preferably the concentrated composition dilutes smoothly to appropriate usage levels. Specific levels of other optional ingredients in the concentrated composition can readily be determined from the desired usage composition and the desired degree of concentration.

Polymers comprising carboxylic acid moieties are preferred for fabric treatment because these polymers provide the desirable qualities of wrinkle removal, reduction and/or control, smoothness, and body desirable from polymers, but do not tend to attract build up of dingy soil in subsequent treatments (wash cycles) as do some other polymers especially cationic polymers. However, when polymers containing carboxylic acid moieties are neutralized, these tend to build a high level of viscosity in the composition, leading to poor dispensing in the form of a highly concentrated spray that will tend to stain fabrics.

Water is inexpensive and effective at breaking hydrogen bonds. Lipophilic fluid and polymers are effective at helping to lubricate fibers, but especially at holding fibers and fabrics in place once the desired smoothness is achieved to retain the smoothness. Polymer compositions disclosed within are typically applied to fabrics by spraying either from a container or within a some type of mechanical chamber (e.g. dryer) for altering the properties of fabrics. Therefore to prevent fabric staining, it is important to have a polymer composition that mists or aerosolizes rather than streaming.

The polymer compositions in lipophilic fluid of the present invention typically comprise:

(A) an effective amount to control wrinkles in fabric of a polymer preferably selected from the group consisting of polymers comprising carboxylic acid moieties that can be suspended or solubilized in at lower pH to produce a solution with a viscosity lower than the viscosity of that polymer composition when the pH is above the specified pH range and with the viscosity of the solution preferably below about 20 cP, more preferably below about 15 cP, even more preferably below about 12 cP, even more preferably below about 10 cP, still more preferably below about 7 cP and most preferably below about 3 cP with the said polymer incorporated at a level that is at least about 0.001%, preferably at least about 0.01%, and more preferably at least about 0.05%, and still more preferably at least about 0.1% and even more preferably at least about 0.25% and most preferably at least about 0.5% and at a level of no greater than about 25%, more preferably no greater than about 10%, even more preferably no greater than about 7%, and still more preferably no greater than about 5% by weight of the usage composition; mixtures of polymers are also acceptable in the present composition; and (B) a co-solvent, that is preferably water; and (C) a carrier, that is preferably a lipophilic fluid.

The preferred polymer compositions of the present invention can optionally further comprise:

(A) optionally, but preferably, silicone compounds and emulsions. Silicone compounds that impart lubricity and softness are highly preferred. Silicones that reduce surface tension are also highly preferred. A preferred class of silicone materials includes silicones modified with alkylene oxide moieties compounds; mixtures of silicones that provide desired benefits are also acceptable in the present composition;

(B) optionally, an effective amount of a supplemental wrinkle control agent selected from the group consisting of (1) adjunct polymer free of carboxylic acid moieties (2) polysaccharides, (3) lithium salts, (4) fiber fabric lubricants, and (5) mixtures thereof;

(C) optionally, an effective amount of a supplemental surface tension control agent;

(D) optionally, an effective amount to soften fibers and/or of hydrophilic plasticizer wrinkle control agent;

(E) optionally, but preferably, at least an effective amount to absorb or reduce malodor, of odor control agent;

(F) optionally, but preferably, an effective amount to provide olfactory effects of perfume;

(G) optionally, an effective amount of solubilized, water-soluble, antimicrobial preservative, preferably from about 0.0001% to about 0.5%, more preferably from about 0.0002% to about 0.2%, most preferably from about 0.0003% to about 0.1%, by weight of the composition;

(H) optionally, an effective amount to adjust and control pH of a pH adjustment system;

(I) optionally, other ingredients such as adjunct odor-controlling materials, chelating agents, viscosity control agents, additional antistatic agents if more static control is desired, insect and moth repelling agents, colorants; whiteness preservatives; and;

(J) mixtures of optional components (A) through (I).

The present polymer compositions are preferably essentially free of any material that would soil or stain fabric under usage conditions, or at least do not contain such materials at a level that would soil or stain fabrics unacceptably under usage conditions. The present compositions are preferably applied as small droplets to fabric when used as a wrinkle spray.

The following describes the ingredients, including optional ingredients, of the present polymer compositions in further detail.

Polymer (A) Carboxylic Acid Moiety-Based Polymers

The polymers comprising carboxylic acid moieties can be natural, or synthetic, and hold fibers in place following drying by forming a film, providing adhesive properties, and/or by other mechanisms. The polymer is typically a homopolymer or a copolymer containing unsaturated organic mono-carboxylic and polycarboxylic acid monomers, and salts thereof, and mixtures thereof. The polymer comprising carboxylic acid moieties is incorporated in the present compositions at a level that is at least about 0.001%, preferably at least about 0.01%, and more preferably at least about 0.05%, and still more preferably at least about 0.1% and even more preferably at least about 0.25% and most preferably at least about 0.5% and at a level of no greater than about 25%, more preferably no greater than about 10%, even more preferably no greater than about 7%, and still more preferably no greater than about 5% by weight of the usage composition.

Polymers comprising carboxylic acid moieties provide the desired properties of wrinkle removal, reduction, and/or control as well as acting to retain the smooth appearance of fabrics as fibers dry and after fibers dry plus providing body without acting to attract soil as some other polymers tend to do, particularly cationic polymers. Polymers comprising carboxylic acid moieties have been typically formulated at pH's above about 6 in order to generate clear solutions. Clear solutions were believed to be preferred for preventing visible residue on fabrics after use. However, when polymers comprising carboxylic acid moieties are solubilized at relatively high pH's these tend to build an unacceptable level of viscosity of the composition which impairs dispensing of the spray. Polymer compositions with high viscosities tend to dispense as streams, which results in staining of fabric.

Surprisingly, it is found that when compositions are at a specified pH, even when these compositions are dispersions of small-size polymer particulates, as opposed to clear solutions containing solubilized polymer, that these compositions tend to dispense as a finer mist—and actually result in less staining than polymer compositions at higher pH's.

As the pH of the carboxylic acid polymer compositions rises, the carboxylic acid moieties tend to de-protonate generating negatively charged head groups along the chain. Electrostatic repulsion between ionized head groups causes the polymers to increase their effective size in solution thus resulting in entanglements between polymers, which raise the viscosity. When viscosity rises, dispensing of the product in the form of a spray becomes difficult because the spray tends to stream, thus focusing an unacceptable volume of product on a small area of the fabric. It was surprisingly found that when the viscosity of the carboxylic acid polymer composition is reduced, by reducing the pH, streaming does not occur. Polymers suitable for this composition disperse or dissolve in solution at low pH to generate a composition with small particles having a viscosity preferably below about 20 cP, more preferably below about 15 cP, even more preferably below about 12 cP, even more preferably below about 10 cP, still more preferably below about 7 cP and most preferably below about 3 cP.

When preferred optional ingredients, e.g. alkylene oxide polysiloxane copolymer, fabric care polysaccharide, odor control components, solvent, and minor ingredients such as perfume and preservative, are added to the carboxylic acid polymer composition, the product tends to become unstable at pH's outside the specified pH range. Many of the preferred optional ingredients (e.g. alkylene oxide polysiloxane, perfume) tend to be hydrophobic and therefore may complex with the polymer if the polymer is significantly protonated. The lower the pH, the more protonated a carboxylic acid-containing polymer becomes and the less electrostatic charge it has. The polymer also become less water soluble and less able to disperse via electrostatic charge mechanisms. Therefore, when the essential polymer is formulated with optional preferred ingredients, especially hydrophobic ingredients, such as polyalkylene oxide polysiloxanes, it can tend to complex with these ingredients and form a precipitate. It is found that shear forces, such as the stirring that occurs during processing or the shaking that can occur during transport, can lead to precipitation of the formula. It is further found that by maintaining a pH within a specified pH range as the formulation is processed, makes the formulation much more stable to shear forces and also maintains a low enough viscosity to allow for acceptable spray dispensing of the final composition. Therefore, when optional preferred ingredients are added to the polymer composition, it is preferred to maintain the pH throughout process and of the finished product within a specified pH range described herein.

Polymers comprising carboxylic acid moieties suitable for the present composition can be natural, or synthetic, and can, as disclosed above, act to hold fibers in place after wrinkles are smoothed out as the fabric dries and after the fabric dries by forming a film, and/or by providing adhesive properties and/or by other mechanisms that act to fix the fibers in place. By "adhesive", it is meant that when applied as a solution or a dispersion to a fiber surface and dried, the polymer can attach to the surface. The polymer can form a film on the surface, or when residing between two fibers and in contact with the two fibers, it can bond the two fibers together. Other polymers such as starches can form a film and/or bond the fibers together when the treated fabric is pressed by a hot iron. Such a film will have adhesive strength, cohesive breaking strength, and cohesive breaking strain.

The synthetic polymers useful in the present invention are comprised of monomers containing carboxylic acid moieties. The polymer can be a homopolymer or a copolymer. The polymer can comprise additional non-carboxylic acid monomers to form copolymers. Copolymers can be either graft or block copolymers. Cross-linked polymers are also acceptable. Some non-limiting examples of carboxylic acid monomers which can be used to form the synthetic polymers of the present invention include: low molecular weight $C_1$–$C_6$ unsaturated organic mono-carboxylic and polycarboxylic acids, such as acrylic acid, methacrylic acid, crotonic acid, maleic acid and its half esters, itaconic acid, and mixtures thereof. Some preferred, but non-limiting monomers include acrylic acid; methacrylic acid; and adipic acid. Salts of carboxylic acids can be useful in generating the synthetic polymers or copolymers as long as the final composition is within a specified pH range and has a viscosity consistent with generating a desirable spray pattern. Additional non-limiting monomers that can be used to generate copolymers comprising carboxylic acid moieties include esters of said acids with $C_1$–$C_{12}$ alcohols, such as methanol, ethanol, 1-propanol, 2-propanol, 1-butanol, 2-methyl-1-propanol, 1-pentanol, 2-pentanol, 3-pentanol, 2-methyl-1-butanol, 1-methyl-1-butanol, 3-methyl-1-butanol, 1-methyl-1-pentanol, 2-methyl-1-pentanol, 3-methyl-1-pentanol, t-butanol, cyclohexanol, 2-ethyl-1-butanol, neodecanol, 3-heptanol, benzyl alcohol, 2-octanol, 6-methyl-t-heptanol, 2-ethyl-1-hexanol, 3,5-dimethyl-1-hexanol, 3,5,5-trimethyl-1-hexanol, 1-decanol, 1-dodecanol, and the like, and mixtures thereof. Nonlimiting examples of said esters are methyl acrylate, ethyl acrylate, t-butyl acrylate, methyl methacrylate, hydroxyethyl methacrylate, methoxy ethyl methacrylate, and mixtures thereof; amides and imides of said acids, such as N,N-dimethylacrylamide, N-t-butyl acrylamide, maleimides; low molecular weight unsaturated alcohols such as vinyl alcohol (produced by the hydrolysis of vinyl acetate after polymerization), allyl alcohol; esters of said alcohols with low molecular weight carboxylic acids, such as, vinyl acetate, vinyl propionate; ethers of said alcohols such as methyl vinyl ether; aromatic vinyl such as styrene, alpha-methylstyrene, t-butylstyrene, vinyl toluene, polystyrene macromer, and the like; polar vinyl heterocyclics, such as vinyl pyrrolidone, vinyl caprolactam, vinyl pyridine, vinyl imidazole, and mixtures thereof; other unsaturated amines and amides, such as vinyl amine, diethylene triamine, dimethylaminoethyl methacrylate, ethenyl formamide; vinyl sulfonate; salts of acids and amines listed above; low molecular weight unsaturated hydrocarbons and derivatives such as ethylene, propylene, butadiene, cyclohexadiene, vinyl chloride; vinylidene chloride; and mixtures thereof and alkyl quaternized derivatives thereof, and mixtures thereof. Preferably, said monomers are selected from the group consisting of vinyl alcohol; methyl acrylate; ethyl acrylate; methyl methacrylate; t-butyl acrylate; t-butyl methacrylate; n-butyl acrylate; n-butyl methacrylate; isobutyl methacrylate; 2-ethylhexyl methacrylate; dimethylaminoethyl methacrylate; N,N-dimethyl acrylamide; N,N-dimethyl methacrylamide; N-t-butyl acrylamide; vinylpyrrolidone; vinyl pyridine; diethylenetriamine; salts thereof and alkyl quaternized derivatives thereof, and mixtures thereof.

Preferably, said monomers form homopolymers and/or copolymers (i.e., the film-forming and/or adhesive polymer) having a glass transition temperature (Tg) of from about −20° C. to about 150° C., preferably from about −10° C. to about 150° C., more preferably from about 0° C. to about 100° C., most preferably, the adhesive polymer hereof, when dried to form a film will have a Tg of at least about 25° C., so that they are not unduly sticky, or "tacky" to the touch. Preferably said polymer comprising carboxylic acid moieties is soluble and/or dispersible in water and/or alcohol. Said polymer typically has a molecular weight of at least about 500, preferably from about 1,000 to about 2,000,000, more preferably from about 5,000 to about 1,000,000, and even more preferably from about 30,000 to about 300,000 for some polymers.

Some non-limiting examples of homopolymers and copolymers which can be used as film-forming and/or adhesive polymers of the present invention are:—adipic acid/dimethylaminohydroxypropyl diethylenetriamine copolymer; ethyl acrylate/methacrylic acid copolymer, adipic acid/epoxypropyl diethylenetriamine copolymer; ethyl acrylate/methyl methacrylate/methacrylic acid/acrylic acid copolymer. Nonlimiting examples of preferred polymers that are commercially available include ethyl acrylate/ methacrylic acid copolymer such as Luvifle® Soft and t-butyl acrylate/ethyl acrylate/methacrylic acid copolymer such as Luvimer® 36D from BASF.

The present compositions containing polymer comprising carboxylic acid moieties can be formulated such that the pH is within a specified pH range. As such, the present compositions have a pH that is at least about 1, preferably at least about 3, and more preferably at least about 5, and that is less than about 7. The preferred pH ranges are from about 3 to about 7, preferably from about 4 to about 6.5, and more preferably from about 5.0 to about 6.0. When optional preferred ingredients are added to the polymer composition it is preferred that the pH of the carboxylic acid polymer composition be within the specified pH range.

The viscosity of the present usage composition is typically below about 20 cP, preferably below about 15 cp, more preferably below about 12 cp, even more preferably below about 10 cp, still more preferably below about 7 cP, and most preferably below about 5 cP. The polymer comprising carboxylic acid moieties is incorporated at a level that is typically at least about 0.001%, preferably at least about 0.01%, more preferably at least about 0.05%, still more preferably at least about 0.25% and most preferably at least about 0.5% and typically lower than about 25%, preferably lower than about 10%, more preferably lower than about 7%, still more preferably lower than about 5%. The level at which the polymer is incorporated is consistent with achieving a low viscosity composition that provides improved dispensing characteristics.

It is not intended to exclude the use of higher or lower levels of the polymers, as long as an effective amount is used to provide wrinkle removal, reduction, and/or control, body and the adhesive, film-forming properties or fixative properties necessary to hold fibers in a smooth conformation as drying occurs and after the fabric dries and as long as the composition can be formulated and effectively applied for its intended purpose and the viscosity of the final composition is acceptable.

Concentrated compositions can also be used in order to provide a less expensive product. When a concentrated product is used, i.e., the polymer is incorporated at a level that is typically about 1% to about 100%, by weight of the concentrated composition. It is preferable to dilute such a concentrated composition before treating fabric. Preferably, the concentrated composition is diluted with about 50% to about 400,000%, more preferably from about 50% to about 300,000%, and even more preferably from about 50% to about 200,000%, even more preferably from about 50% to about 125,000% by weight of the composition, of water. Liquid concentrates are acceptable, but solid concentrates are preferred. Preferred concentrates will dilute smoothly from the concentrated state to the usage state.

(B) Silicone-Base Polymers

Another set of highly preferred adhesive and/or film forming polymers that are useful in the composition of the present invention comprise silicone moieties in the polymers. These preferred polymers include graft and block copolymers of silicone with moieties containing hydrophilic and/or hydrophobic monomers described hereinbefore. The silicone-containing copolymers in the spray composition of the present invention provide shape retention, body, and/or good, soft fabric feel.

Both silicone-containing graft and block copolymers useful in the present invention as polymers comprising carboxylic acid moieties typically have the following properties:

(1) The polymer comprises carboxylic acid moieties;

(2) the silicone portion is covalently attached to the non-silicone portion;

(3) the molecular weight of the silicone portion is from about 1,000 to about 50,000 and;

(4) the non-silicone portion must render the entire copolymer dispersible or soluble in the wrinkle control composition vehicle and permit the copolymer to deposit on/adhere to the treated fabrics.

Suitable silicone copolymers include the following:

(1) SILICONE GRAFT COPOLYMERS

Silicone-containing polymers useful in the present invention are the silicone graft copolymers comprising carboxylic acid moieties as disclosed above. Polymers of this description, along with methods for making them are described in U.S. Pat. No. 5,658,557, Bolich et al., issued Aug. 19, 1997, U.S. Pat. No. 4,693,935, Mazurek, issued Sep. 15, 1987, and U.S. Pat. No. 4,728,571, Clemens et al., issued Mar. 1, 1988.

These polymers preferably include copolymers having a vinyl polymeric backbone having grafted onto it monovalent siloxane polymeric moieties, and components consisting of non-silicone hydrophilic and hydrophobic monomers of the type disclosed above including carboxylic acid moieties.

The silicone-containing monomers are exemplified by the general formula:

$$X(Y)_nSi(R)_{3-m}Z_m$$

wherein X is a polymerizable group, such as a vinyl group, which is part of the backbone of the polymer; Y is a divalent linking group; R is a hydrogen, hydroxyl, lower alkyl (e.g. $C_1$–$C_4$), aryl, alkaryl, alkoxy, or alkylamino; Z is a monovalent polymeric siloxane moiety having an average molecular weight of at least about 500, is essentially unreactive under copolymerization conditions, and is pendant from the vinyl polymeric backbone described above; n is 0 or 1; and m is an integer from 1 to 3.

The preferred silicone-containing monomer has a weight average molecular weight of from about 1,000 to about 50,000, preferably from about 3,000 to about 40,000, most preferably from about 5,000 to about 20,000.

Nonlimiting examples of preferred silicone-containing monomers have the following formulas:

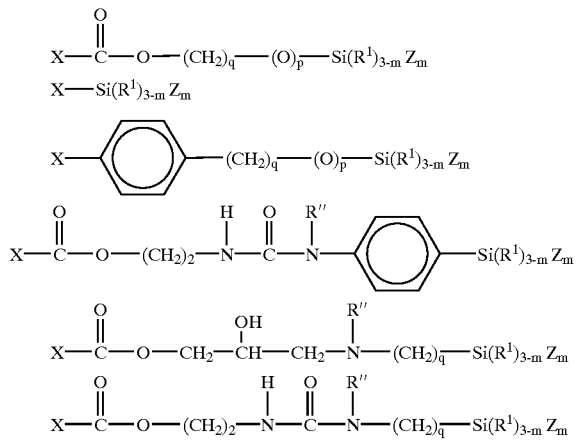

In these structures m is an integer from 1 to 3, preferably 1; p is 0 or 1; q is an integer from 2 to 6; n is an integer from 0 to 4, preferably 0 or 1, more preferably 0; [1] is hydrogen, lower alkyl, alkoxy, hydroxyl, aryl, alkylamino, preferably $R^1$ is alkyl; R" is alkyl or hydrogen; X is $$CH(R^3)=\!=C(R^4)-$$

$R^3$ is hydrogen or —COOH, preferably hydrogen; $R^4$ is hydrogen, methyl or —$CH_2$COOH, preferably methyl; Z is $$R^5-[Si(R^6)(R^7)-O-]_r$$

wherein $R^5$, $R^6$, and $R^7$, independently are lower alkyl, alkoxy, alkylamino, hydrogen or hydroxyl, preferably alkyl; and r is an integer of from about 5 to about 700, preferably from about 60 to about 400, more preferably from about 100 to about 300. Most preferably, $R^5$, $R^6$, and $R^7$ are methyl, p=0, and q=3.

The silicone-containing copolymers preferably have a weight average molecular weight of from about 10,000 to about 1,000,000, preferably from about 30,000 to about 300,000.

The preferred polymers comprise a vinyl polymeric backbone, preferably having a Tg or a Tm as defined above of about −20° C. and, grafted to the backbone, a polydimethylsiloxane macromer having a weight average molecular weight of from about 1,000 to about 50,000, preferably from about 5,000 to about 40,000, most preferably from about 7,000 to about 20,000. The polymer is such that when it is formulated into the finished composition, and then dried, the polymer phase separates into a discontinuous phase which includes the polydimethylsiloxane macromer and a continuous phase which includes the backbone.

Silicone-containing graft copolymers suitable for the present invention contain hydrophobic monomers, silicone-containing monomers and hydrophilic monomers which comprise unsaturated organic mono- and polycarboxylic acid monomers, such as acrylic acid, methacrylic acid, crotonic acid, maleic acid and its half esters, itaconic acid, and salts thereof, and mixtures thereof. These preferred polymers surprisingly also provide control of certain amine type malodors in fabrics, in addition to providing the fabric wrinkle control benefit. A nonlimiting example of such copolymer is n-butylmethacrylate/acrylic acid/(polydimethylsiloxane macromer, 20,000 approximate molecular weight) copolymer of average molecular weight of about 100,000, and with an approximate monomer weight ratio of about 70/10/20. A highly preferred copolymer is composed of acrylic acid, t-butyl acrylate and silicone-containing monomeric units, preferably with from about 20% to about 90%, preferably from about 30% to about 80%, more preferably from about 50% to about 75% t-butyl acrylate; from about 5% to about 60%, preferably from about 8% to about 45%, more preferably from about 10% to about 30% of acrylic acid; and from about 5% to about 50%, preferably from about 10% to about 40%, more preferably from about 15% to about 30% of polydimethylsiloxane of an average molecular weight of from about 1,000 to about 50,000, preferably from about 5,000 to about 40,000, most preferably from about 7,000 to about 20,000. Nonlimiting examples of acrylic acid/tert-butyl acrylate/polydimethyl siloxane macromer copolymers useful in the present invention, with approximate monomer weight ratio, are: t-butylacrylate/acrylic acid/(polydimethylsiloxane macromer, 10,000 approximate molecular weight) (70/10/20 w/w/w), copolymer of average molecular weight of about 300,000; t-butyl acrylate/acrylic acid/(polydimethylsiloxane macromer, 10,000 approximate molecular weight) (63/20/17), copolymer of average molecular weight of from about 120,000 to about 150,000; and n-butylmethacrylate/acrylic acid/(polydimethylsiloxane macromer—20,000 approximate molecular weight) (70/10/20 w/w/w), copolymer of average molecular weight of about 100,000. A useful and commercially available copolymer of this type is Diahold® ME from Mitsubishi Chemical Corp., which is a t-butyl acrylate/acrylic acid/(polydimethylsiloxane macromer, 12,000 approximate molecular weight) (60/20/20), copolymer of average molecular weight of about 128,000.

(2) SILICONE BLOCK COPOLYMERS

Also useful herein are silicone block copolymers comprising repeating block units of polysiloxanes, as well as carboxylic acid moieties.

The silicone-containing block copolymers useful in the present invention can be described by the formulas A—B, A—B—A, and $—(A—B)_n—$ wherein n is an integer of 2 or greater. A—B represents a diblock structure, A—B—A represents a triblock structure, and $—(A—B)_n—$ represents a multiblock structure. The block copolymers can comprise mixtures of diblocks, triblocks, and higher multiblock combinations as well as small amounts of homopolymers.

The silicone block portion, B, can be represented by the following polymeric structure $$—(SiR_2O)_m—,$$

wherein each R is independently selected from the group consisting of hydrogen, hydroxyl, $C_1$–$C_6$ alkyl, $C_1$–$C_6$ alkoxy, $C_2$–$C_6$ alkylamino, styryl, phenyl, $C_1$–$C_6$ alkyl or alkoxy-substituted phenyl, preferably methyl; and m is an integer of about 10 or greater, preferably of about 40 or greater, more preferably of about 60 or greater, and most preferably of about 100 or greater.

The non-silicone block, A, comprises carboxylic acid moieties. These polymers can also contain monomers selected from the monomers as described hereinabove in reference to the non-silicone hydrophilic and hydrophobic monomers for the silicone grafted copolymers. The non-silicone block A can contain also comprises amino acids (e.g. including but not limited to cystine as represented by the nonlimiting example Crodasone Cystine® from Croda).

When the optional cyclodextrin is present in the composition, the polymer useful in the composition of the present invention should be cyclodextrin-compatible, that is it should not substantially form complexes with cyclodextrin so as to diminish performance of the cyclodextrin and/or the polymer. Complex formation affects both the ability of the cyclodextrin to absorb odors and the ability of the polymer to impart shape retention to fabric. In this case, the monomers having pendant groups that can complex with cyclodextrin are not preferred because they can form complexes with cyclodextrin. Examples of such monomers are acrylic or methacrylic acid esters of $C_7$–$C_{18}$ alcohols, such as neodecanol, 3-heptanol, benzyl alcohol, 2-octanol, 6-methyl-1-heptanol, 2-ethyl-1-hexanol, 3,5-dimethyl-1-hexanol, 3,5,5-trimethyl-1-hexanol, and 1-decanol; aromatic vinyls, such as styrene; t-butylstyrene; vinyl toluene; and the like.

Co-Solvent

The preferred co-solvent of the present invention is water. The water which is used can be distilled, deionized, or tap water. Water is the preferred main liquid carrier due to its low cost, availability, safety, and environmental compatibility. Aqueous solutions are preferred for wrinkle control and odor control.

Water is very useful for fabric wrinkle removal or reduction. It is believed that water breaks many intrafiber and interfiber hydrogen bonds that keep the fabric in a wrinkle state. It also swells, lubricates and relaxes the fibers to help the wrinkle removal process.

Water also serves as the liquid carrier for the cyclodextrins, and facilitates the complexation reaction between the cyclodextrin molecules and any malodorous molecules that are on the fabric when it is treated. The dilute aqueous solution also provides the maximum separation of cyclodextrin molecules on the fabric and thereby maximizes the chance that an odor molecule will interact with a cyclodextrin molecule. It has also been discovered that water has an unexpected odor controlling effect of its own. It has been discovered that the intensity of the odor generated by some polar, low molecular weight organic amines, acids, and mercaptans is reduced when the odor-contaminated fabrics are treated with an aqueous solution. It is believed that water solubilizes and depresses the vapor pressure of these polar, low molecular weight organic molecules, thus reducing their odor intensity.

The level of co-solvent in the compositions of the present invention is typically greater than about 0.1%, preferably greater than about 5%, and more preferably greater than about 7%, but no more than 25%, more preferably no more than 15%, and even more preferably no more than 10% by weight of the composition. When a concentrated composition is used, the level of co-solvent is typically equal to or below about 90%, by weight of the composition, preferably equal to or below about 70%, more preferably equal to or below about 50%, even more preferably equal to or below about 30% by weight of the concentrated composition.

Carrier

The preferred carrier of the present invention is a lipophilic fluid.

Lipophilic Fluid

The lipophilic fluid herein is one having a liquid phase present under operating conditions of a fabric/leather article treating appliance, in other words, during treatment of a fabric article in accordance with the present invention. In general such a lipophilic fluid can be fully liquid at ambient temperature and pressure, can be an easily melted solid, e.g., one which becomes liquid at temperatures in the range from about 0 deg. C. to about 60 deg. C., or can comprise a mixture of liquid and vapor phases at ambient temperatures and pressures, e.g., at 25 deg C. and 1 atm. pressure. Thus, the lipophilic fluid is not a compressible gas such as carbon dioxide.

It is preferred that the lipophilic fluids herein be nonflammable or have relatively high flash points and/or low VOC (volatile organic compound) characteristics, these terms having their conventional meanings as used in the dry cleaning industry, to equal or, preferably, exceed the characteristics of known conventional dry cleaning fluids.

Moreover, suitable lipophilic fluids herein are readily flowable and nonviscous.

In general, lipophilic fluids herein are required to be fluids capable of at least partially dissolving sebum or body soil as defined in the test hereinafter. Mixtures of lipophilic fluid are also suitable, and provided that the requirements of the Lipophilic Fluid Test, as described below, are met, the lipophilic fluid can include any fraction of dry-cleaning solvents, especially newer types including fluorinated solvents, or perfluorinated amines. Some perfluorinated amines such as perfluorotributylamines while unsuitable for use as lipophilic fluid may be present as one of many possible adjuncts present in the lipophilic fluid-containing composition.

Other suitable lipophilic fluids include, but are not limited to, diol solvent systems e.g., higher diols such as $C_6$- or $C_8$- or higher diols, organosilicone solvents including both cyclic and acyclic types, and the like, and mixtures thereof.

A preferred group of nonaqueous lipophilic fluids suitable for incorporation as a major component of the compositions of the present invention include low-volatility nonfluorinated organics, silicones, especially those other than amino functional silicones, and mixtures thereof. Low volatility nonfluorinated organics include for example OLEAN® and other polyol esters, or certain relatively nonvolatile biodegradable mid-chain branched petroleum fractions.

Another preferred group of nonaqueous lipophilic fluids suitable for incorporation as a major component of the compositions of the present invention include, but are not limited to, glycol ethers, for example propylene glycol methyl ether, propylene glycol n-propyl ether, propylene glycol t-butyl ether, propylene glycol n-butyl ether, dipropylene glycol methyl ether, dipropylene glycol n-propyl ether, dipropylene glycol t-butyl ether, dipropylene glycol n-butyl ether, tripropylene glycol methyl ether, tripropylene glycol n-propyl ether, tripropylene glycol t-butyl ether, tripropylene glycol n-butyl ether. Suitable silicones for use as a major component, e.g., more than 50%, of the composition include cyclopentasiloxanes, sometimes termed "D5", and/or linear analogs having approximately similar volatility, optionally complemented by other compatible silicones. Suitable silicones are well known in the literature, see, for example, Kirk Othmer's Encyclopedia of Chemical Technology, and are available from a number of commercial sources, including General Electric, Toshiba Silicone, Bayer, and Dow Corning. Other suitable lipophilic fluids are commercially available from Procter & Gamble or from Dow Chemical and other suppliers.

Qualification of Lipophilic Fluid and Lipophilic Fluid Test (LF Test)

Any nonaqueous fluid that is both capable of meeting known requirements for a dry-cleaning fluid (e.g, flash point etc.) and is capable of at least partially dissolving sebum, as indicated by the test method described below, is suitable as a lipophilic fluid herein. As a general guideline, perfluorobutylamine (Fluorinert FC-43®) on its own (with or without adjuncts) is a reference material which by definition is unsuitable as a lipophilic fluid for use herein (it is essentially a nonsolvent) while cyclopentasiloxanes have suitable sebum-dissolving properties and dissolves sebum.

The following is the method for investigating and qualifying other materials, e.g., other low-viscosity, free-flowing silicones, for use as the lipophilic fluid. The method uses commercially available Crisco® canola oil, oleic acid (95% pure, available from Sigma Aldrich Co.) and squalene (99% pure, available from J. T. Baker) as model soils for sebum. The test materials should be substantially anhydrous and free from any added adjuncts, or other materials during evaluation.

Prepare three vials, each vial will contain one type of lipophilic soil. Place 1.0 g of canola oil in the first; in a second vial place 1.0 g of the oleic acid (95%), and in a third and final vial place 1.0 g of the squalene (99.9%). To each vial add 1 g of the fluid to be tested for lipophilicity. Separately mix at room temperature and pressure each vial containing the lipophilic soil and the fluid to be tested for 20 seconds on a standard vortex mixer at maximum setting. Place vials on the bench and allow to settle for 15 minutes at room temperature and pressure. If, upon standing, a clear single phase is formed in any of the vials containing lipophilic soils, then the nonaqueous fluid qualifies as suitable for use as a "lipophilic fluid" in accordance with the present invention. However, if two or more separate layers are formed in all three vials, then the amount of nonaqueous fluid dissolved in the oil phase will need to be further determined before rejecting or accepting the nonaqueous fluid as qualified.

In such a case, with a syringe, carefully extract a 200-microliter sample from each layer in each vial. The syringe-extracted layer samples are placed in GC auto sampler vials and subjected to conventional GC analysis after determining the retention time of calibration samples of each of the three models soils and the fluid being tested. If more than 1% of the test fluid by GC, preferably greater, is found to be present in any one of the layers which consists of the oleic acid, canola oil or squalene layer, then the test fluid is also qualified for use as a lipophilic fluid. If needed, the method can be further calibrated using heptacosafluorotributylamine, i.e., Fluorinert FC-43 (fail) and cyclopentasiloxane (pass). A suitable GC is a Hewlett Packard Gas Chromatograph HP5890 Series II equipped with a split/splitless injector and FID. A suitable column used in determining the amount of lipophilic fluid present is a J&W Scientific capillary column DB-1HT, 30 meter, 0.25 mm id, 0.1 um film thickness cat# 1221131. The GC is suitably operated under the following conditions:

Carrier Gas: Hydrogen

Column Head Pressure: 9 psi

Flows: Column Flow @ ~1.5 ml/min.
Split Vent @ ~250–500 m/min.

Septum Purge @ 1 ml/min.

Injection: HP 7673 Autosampler, 10 ul syringe, 1 ul injection

Injector Temperature: 350° C.

Detector Temperature: 380° C.

Oven Temperature Program: initial 60° C. hold 1 min. rate 25° C./min. final 380° C. hold 30 min.

Preferred lipophilic fluids suitable for use herein can further be qualified for use on the basis of having an excellent garment care profile. Garment care profile testing is well known in the art and involves testing a fluid to be qualified using a wide range of garment or fabric article components, including fabrics, threads and elastics used in seams, etc., and a range of buttons. Preferred lipophilic fluids for use herein have an excellent garment care profile, for example they have a good shrinkage and/or fabric puckering profile and do not appreciably damage plastic buttons. Certain materials which in sebum removal qualify for use as lipophilic fluids, for example ethyl lactate, can be quite objectionable in their tendency to dissolve buttons, and if such a material is to be used in the compositions of the present invention, it will be formulated with water and/or other solvents such that the overall mix is not substantially damaging to buttons. Other lipophilic fluids, D5, for example, meet the garment care requirements quite admirably. Some suitable lipophilic fluids may be found in granted U.S. Pat. Nos. 5,865,852; 5,942,007; 6,042,617; 6,042,618; 6,056,789; 6,059,845; and 6,063,135, which are incorporated herein by reference.

Lipophilic fluids can include linear and cyclic polysiloxanes, hydrocarbons and chlorinated hydrocarbons, with the exception of PERC and DF2000 which are explicitly not covered by the lipophilic fluid definition as used herein. More preferred are the linear and cyclic polysiloxanes and hydrocarbons of the glycol ether, acetate ester, lactate ester families. Preferred lipophilic fluids include cyclic siloxanes having a boiling point at 760 mm Hg. of below about 250° C. Specifically preferred cyclic siloxanes for use in this invention are octamethylcyclotetrasiloxane, decamethylcyclopentasiloxane, and dodecamethylcyclohexasiloxane. Preferably, the cyclic siloxane comprises decamethylcyclopentasiloxane (D5, pentamer) and is substantially free of octamethylcyclotetrasiloxane (tetramer) and dodecamethylcyclohexasiloxane (hexamer).

However, it should be understood that useful cyclic siloxane mixtures might contain, in addition to the preferred cyclic siloxanes, minor amounts of other cyclic siloxanes including octamethylcyclotetrasiloxane and hexamethylcyclotrisiloxane or higher cyclics such as tetradecamethylcycloheptasiloxane. Generally the amount of these other cyclic siloxanes in useful cyclic siloxane mixtures will be less than about 10 percent based on the total weight of the mixture. The industry standard for cyclic siloxane mixtures is that such mixtures comprise less than about 1% by weight of the mixture of octamethylcyclotetrasiloxane.

Accordingly, the lipophilic fluid of the present invention preferably comprises more than about 50%, more preferably more than about 75%, even more preferably at least about 90%, most preferably at least about 95% by weight of the lipophilic fluid of decamethylcyclopentasiloxane. Alternatively, the lipophilic fluid may comprise siloxanes which are a mixture of cyclic siloxanes having more than about 50%, preferably more than about 75%, more preferably at least about 90%, most preferably at least about 95% up to about 100% by weight of the mixture of decamethylcyclopentasiloxane and less than about 10%, preferably less than about 5%, more preferably less than about 2%, even more preferably less than about 1%, most preferably less than about 0.5% to about 0% by weight of the mixture of octamethylcyclotetrasiloxane and/or dodecamethylcyclohexasiloxane.

The level of lipophilic fluid, when present in the treating compositions according to the present invention, is preferably from about 70% to about 99.99%, more preferably from about 90% to about 99.9%, and even more preferably from about 95% to about 99.8% by weight of the treating composition.

The level of lipophilic fluid, when present in the consumable fabric article treating/cleaning compositions according to the present invention, is preferably from about 0.1% to about 90%, more preferably from about 0.5% to about 75%, and even more preferably from about 1% to about 50% by weight of the consumable fabric article treating/cleaning composition.

In addition to the above lipophilic solvents, carbon dioxide-philic surfactants can be included in the lipophilic fluid of the present invention. Nonlimiting examples of such carobn dioxide-philic surfactants are described in U.S. Pat. Nos. 5,977,045, 5,683,977, 5,683,473 and 5,676,705.

If the lipophilic fluid of the present invention comprises a carbon dioxide-philic surfactant, such surfactant preferably is present at a level of from about 0.001% to about 10% by weight of the lipophilic fluid.

Other Solvents and/or Plasticizers

Optionally, in addition to lipophilic fluid and co-solvent, the carrier can further comprise solvents and plasticizers that act to aid the natural ability of water to plasticize fibers. Acceptable solvents and plasticizers include compounds having from one to ten carbons. The following non-limiting classes of compounds are suitable: mono-alcohols, diols, polyhydric alcohols, ethers, ketones, esters, organic acids, and alkyl glyceryl ethers, and hydrocarbons. Preferred solvents are soluble in water and/or miscible in the presence of optional surfactant. Some nonlimiting examples include methanol, ethanol, isopropanol, hexanol, 1,2-hexanediol, hexylene glycol, (e.g. 2-methyl-2,4-pentanediol), isopropylene glycol (3-methyl-1,3-butanediol), 1,2-butylene glycol, 2,3-butylene glycol, 1,3-butylene glycol, 1,4-butylene glycol, 1,3-propylene glycol, 1,2-propylene glycol, isomers of cyclohexanedimethanol, isomers of propanediol, isomers of butanediol, the isomers of trimethylpentanediol, the isomers of ethylmethylpentanediol, alcohol ethoxylates of 2-ethyl-1,3-hexanediol, 2,2,4-trimethyl-1,3-pentanediol, alcohol ethoxylates of 2,2,4-trimethyl-1,3-pentanediol glycerol, ethylene glycol, diethylene glycol, dipropylene glycol, sorbitol, 3-methyl-3-methoxybutanol, 3-methoxybutanol, 1-ethoxy-2-propanol, diethylene glycol monoethyl ether, diethylene glycol monopropyl ether, diethylene glycol monobutyl ether, triethylene glycol monoethyl ether, erythritol, and mixtures of solvents and plasticizers. When optional cyclodextrin is present, the plasticizer should be compatible with it. Mixtures of solvents are also suitable. When solvent is used, it is used typically at a level of at least about 0.5%, preferably at least about 1%, more preferably at least about 2%, even more preferably at least about 3% and still more preferably at least about 4% and typically less than about 30%, preferably less than about 25%, more preferably less than about 20%, even more preferably less than about 15% by weight of the composition.

(C) Optional Ingredients

In highly preferred compositions, the present low-viscosity polymer composition can also comprise: (1) optional, but highly preferably, silicon, compounds and emulsions, such an Silwet® surfactants; (2) optional supplemental wrinkle control agents selected from, adjunct polymers, fabric care polysaccharides, lithium salts, fiber-fabric lubricants, and mixtures thereof; (3) optional surface tension control agents; (4) optional viscosity control compounds; (5) optional hydrophilic plasticizer (6) optional, but preferable, odor control agent; (7) optional, but preferable, perfume; (8) optional, but preferable, antimicrobial active; (9) optional chelator, e.g., aminoccarboxylate chelator; (10) optional buffer system; (11) optional water-soluble polyionic polymer; (12) optional viscosity control agent; (13) optional antistatic agent; (14) optional insert and moth repellant; (15) optional colorant; (16) optional anti-clogging agent; (17) optional whiteness preservative: and (18) mixtures thereof. The composition of the present invention may also include other optional adjunct ingredients, such an bleaches, emulsifiers, fabric softeners, antibacterial agents, brighteners, dye fixatives, dye abrasion inhibitors, anti-crocking agents, soil release polymers, sunscreen agents, anti-fading agents, water-proofing agents, stain proofing agents, soil repellency agents, and mixtures thereof.

Methods

The methods of the present invention comprise one or more of the following steps A–E. The steps may occur at any time during the method. Further, each and every step may be independently repeated one or more times. Following the one or more steps A–E, the method may also comprise steps F and/or G.

The time to complete the method of the present invention can vary quite widely. For example, the method can take from about 30 seconds to about 30 minutes. More generally, a complete de-wrinkling or fabric treatment operation of fabric articles, from start to end can take from about 5 minutes to about three hours, or even longer. If, for example, a low-energy overnight mode of operation is contemplated or a cleaning operation is to be followed by additional fabric treatment, the method may take several hours.

The total processing time will also vary with the precise appliance design. For example, appliance variations having reduced pressure or "vacuum" means can help reduce cycle time. Alternatively, embodiments involving longer times may be less desirable for the consumer but may be imposed by energy-saving requirements varying from country to country. Typical processes include those taking from about 20 minutes to about two hours in total. The balance of process time apart from the various cleaning fluid application stages will typically be dedicated to removal and/or finishing of the fabrics. For example, conventional prespotting, soaking or pretreating may be performed on the fabric articles prior to de-wrinkling them in accordance with the present invention.

Further, the method of the present invention may be used for treating an unsorted load of fabric articles without substantial damage or dye-transfer between said articles. By "unsorted fabric articles" it is meant that the fabric articles to be treated comprise two or more articles selected from the group consisting of articles having "dry clean only" care labels. In other words, it is contemplated that the present method be utilized in an apparatus that can clean dry clean only fabrics and fabrics which can be water washed in the same apparatus and at the same time.

A. Applying De-Wrinkling Fluid

In accordance with the present invention, the de-wrinkling fluid may be applied to the fabric articles by any suitable means known to those skilled in the art. Non-limiting examples of application means include spraying, dipping, brushing on, rubbing on, and the like. A desirable application means comprises spraying.

It is desirable that the de-wrinkling fluid is applied such that it uniformly contacts the fabric articles. Such uniformity of de-wrinkling fluid application can be achieved for example by applying a cleaning fluid to fabric articles and then concurrently or subsequently repositioning the fabric articles, such as by tumbling or otherwise moving the fabric articles, to expose non-contacted portions of the fabric articles to the cleaning fluid application or subsequent cleaning fluid application.

However, uniformity of distribution is not absolutely necessary, especially for those fabric care agents that can provide their desired benefit to the fabric article without being uniformly distributed on a fabric article. A non-limiting example of such a fabric care agent is a perfume.

An effective amount of the de-wrinkling fluid is applied to the fabric articles such that the de-wrinkling fluid provides the desired fabric care benefit to the fabric articles, such as de-wrinkling, conditioning, refreshing, sizing, etc.

The application of the de-wrinkling fluid to the fabric articles may be repeated as necessary. Further, the repositioning (i.e., by way of tumbling) of the fabric articles during and/or between applications of the de-wrinkling fluid is desirable.

It is acceptable to apply a quantity of de-wrinkling fluid to the fabric articles such that a quantity of lipophilic fluid of from about 20% by dry weight of the fabric articles up to the absorption capacity of the fabric articles is applied to the fabric articles. An important aspect of the present invention is that fabric de-wrinkling or treatment is accomplished with relatively small amounts of de-wrinkling fluid. The amount of de-wrinkling fluid should be just sufficient to completely and uniformly wet the fabric articles. The amount of de-wrinkling fluid needed to uniformly wet fabrics will depend on factors such as the nature of the fibers used in the fabric (whether wool, silk, cotton, polyester, nylon, etc.), the denier of the fiber used in the fabric, the closeness of the weave, etc.

For example, the amount of de-wrinkling fluid applied to a fabric article will be at least about 20% by dry weight of the fabric articles, and not more than about 200% by weight of the fabric articles. In many applications an amount of de-wrinkling fluid of from about 75% to about 150% by weight of the fabric articles is preferred, with an amount of about 100% by weight of the fabric articles being particularly preferred. However, it is to be understood that the amount of de-wrinkling fluid applied to a fabric article will vary depending upon the absorption capacity of the fabric articles to be treated.

The de-wrinkling fluid comprises from at least about 50% to about 100% by weight of de-wrinkling fluid of a lipophilic fluid and optionally from about 0% to about 50% by weight of de-wrinkling fluid of an adjunct ingredient. The de-wrinkling fluid can comprise one or more liquid phases and can be in the form of an emulsion or micro-emulsion form. The lipophilic fluid and adjunct ingredients will now be explained in more detail.

The total amount of de-wrinkling fluid used in one treatment cycle, that is the total amount of de-wrinkling fluid applied to and removed from the fabric articles in the process of the present invention from the time the process is commenced until it is finished is from about 10% to about 1500%, even more preferably from about 10% to about 500%, even more preferably from about 10% to about 250%, even more preferably from about 30% to about 150%, even more preferably from about 80% to about 130%, even more preferably still from about 100% to about 120% by weight of the dry fabric articles. One suitable cleaning fluid composition comprises about 85% to 90% by weight of lipophilic fluid, preferably a silicone, such as cyclopentasiloxane, and from about 15% to about 10% of adjunct ingredients.

Since the "absorption capacity" of different fabric articles vary, the amount of de-wrinkling fluid used with the different fabric articles can vary. For example, for fabric articles that have a greater absorption capacity, more de-wrinkling fluid and thus, more lipophilic fluid can be used. Non-limiting examples of absorption capacities of fabric articles are described below:

Sample Table for Fabric Absorbency

| Fabric Type | Structure | Average absorbency, % |
|---|---|---|
| Cotton, C61 | Mesh | 165 |
| Cotton, C77 | Knit | 330 |
| Cotton, CW19 | Towel | 480 |
| Polycotton, PC49 | Knit | 170 |
| Polycotton, BC | Corduroy | 200 |
| Polyester, PW18 | knit | 240 |
| Wool, W4 | knit | 330 |
| Wool, W522 | knit | 250 |
| Acrylate, ACR8 | knit | 340 |
| Nylon, N18 | knit | 210 |
| Nylon, N21 | knit | 140 |
| Silk | knit | 190 |

(Absorbency of fabrics determined using the Test Protocol for Measuring Absorption Capacity of a Fabric Article as described hereinabove.)

The amount of lipophilic fluid evenly distributed onto the fabric article(s) will depend on a wide range of factors, such as, type of fluid, its affinity to fabrics, garment construction, wrinkle amount to be removed, etc. For example, typically, fine, thin garments will require lesser amount of de-wrinkling fluid than heavier garments. However, the quantity of lipophilic fluid is such, that there is none or minimal amounts of lipophilic fluid in excess of the absorption capacity of the fabric article(s) being treated, which is typically about 150%, by dry weight of the fabric article(s). Typically, in a domestic situation the amount of lipophilic fluid is based on weight, type of garments, wrinkle amount, and can be controlled by user-selectable interface choosing the most appropriate cycle, much in the same fashion as a consumer would on a conventional washing machine.

B. Mechanically Removing Cleaning Fluid

In accordance with the present invention, lipophilic fluid present on the fabric articles does not need to be mechanically removed. It is desirable to remove the de-wrinkling fluid by other means to avoid additional mechanical forces that may cause crease formation. Nonlimiting examples of forces that can produce creases include squeezing, pressing, or otherwise flattening the fabric articles.

C. Evaporatively Removing Cleaning Fluid

The lipophilic fluid present on the fabric articles may be evaporatively removed. The amount of lipophilic fluid evaporatively removed varies depending on the quantity of lipophilic fluid present on the fabric articles, other materials in addition to the lipophilic fluid present on the fabric articles, the type of fabric articles, and the like. Evaporatively removing the lipophilic fluid from the fabric articles is a desirable way to remove a quantity of lipophilic fluid that remains on the fabric articles after the application step.

The evaporative removal step can be considered a "drying" step. The purpose of the evaporative removal step is to remove a quantity of lipophilic fluid from the fabric articles such that the fabric articles are "dry to the touch".

Physical conditions and/or chemical agents/conditions may be used to facilitate the evaporative removal of the lipophilic fluid. For example, drying aids (i.e., any chemical agent that evaporates more readily than the lipophilic fluid used in the method that reduce the time for drying of the fabric articles treated in the method of the present invention). Non-limiting examples of such drying aids include alcohols, hydrofluoroethers, esters and mixtures thereof. Additional conditions that can be used to reduce the time for drying of the fabric articles include, but are not limited to, contacting the fabric articles with heated gas and/or circulating gas, and/or repositioning the fabric articles during the evaporative removal step.

The heated gas may be air, or may be an inert gas such as nitrogen, depending on the cleaning fluid being evaporatively removed. This step may be carried out at atmospheric pressure or at a reduced pressure. Operating at a reduced pressure permits evaporative removal at a lower temperature.

It is desirable to select conditions (gas temperature, pressure, flow rate) such that the evaporative removal step be completed in less than an hour, preferably in less than 45 minutes.

Upon the completion of the evaporative removal step the fabric articles will be ready for their intended use.

D. Contacting with Impinging Gas

In accordance with the present invention, the fabric articles to be treated and/or cleaned may be contacted with an impinging gas at any time during the method of the present invention.

It is desirable that an impinging gas contacts the fabric articles at least prior to applying the de-wrinkling fluid. The impinging gas facilitates the removal particulate soils from the fabric articles. Particulate soils can be successfully removed using gas flow. Particulate soils include any soil that is comprised of discrete particles. Nonlimiting examples of such particulate soils include clay, dust, dried mud, sand, cat fur, skin flakes or scales, dander, dandruff, hair from people or pets, grass seeds, pollen, burrs, and/or similar animal, mineral or vegetable matter which is insoluble in water.

By utilizing the impinging gas, "demand" on chemicals in the process for removing such particulate soils is reduced.

Typically, the impinging gas is flow from a gas source at a rate of from about 10 l/s to about 70 l/s and the gas contacts the fabric articles at a velocity of from about 1 m/s to about 155 m/s. It is desirable to mechanically agitate the fabric articles while the gas impinges on the fabric articles. Further, it is desirable to remove the gas, and particulate soils in the gas from the fabric articles at a rate sufficient to prevent the removed particulate soils from re-depositing upon the fabric articles.

In one embodiment of the present invention the gas is selected from the group consisting of air, nitrogen, ozone, oxygen, argon, helium, neon, xenon, and mixtures thereof, more preferably air, nitrogen, ozone, oxygen, argon, helium, and mixtures thereof, even more preferably still air, ozone, nitrogen, and mixtures thereof.

In another embodiment of the present invention the gas used in the method can be varied over time. For example air could be used at the start of the process, a mixture of air and ozone used in the middle stages of the process and air or nitrogen could be used at the end.

The gas used may be of any suitable temperature or humidity. Heat could be supplied to the gas electrically or by passing the gas over a gas flame, such as, is done in a conventional gas dryer. However, room temperature and humidity gas are preferred.

In one embodiment of the present invention two or more gases could be mixed in a mixing chamber before being used in the process. In another aspect of this embodiment of the present invention the gases could be delivered concurrently through different entry points and mix in-situ in the walled vessel. In another aspect of this embodiment of the present invention the gases supplied could exist as mixture and would not require any mixing chamber to achieve the required mixture of gas for the process.

In one embodiment of the present invention the gas could be available from storage, such as from pressurized containers. Alternatively, the gas used in the process could be obtained from the location where the process and device occur. For example, a pump, blower, or the like, may be used to supply air from the surrounding atmosphere for the process of the invention. A combination of gas available from storage and from the atmosphere is also envisioned.

In another embodiment of the present invention the gas can be obtained from a compressor. The compressor may be any compressor suitable for providing gas or gases, provided that they supply the gas to the apparatus within the required velocity and flow rate ranges. The compressors are linked to the gas inlet(s) by an appropriate fixture, such as a hose, pipe, tap, fixture or combinations thereof, to provide the inlet(s) with the gas or gases within the required velocity and flow rate ranges. Some typical compressors, which are suitable for providing gas or gases, include rotary screw compressors or two-stage electrical compressor. Another suitable type of compressor is the so-called "acoustical compressor", such as those described in U.S. Pat. Nos. 5,020,977, 5,051,066, 5,167,124, 5,319,938, 5,515,684, 5,231,337, and 5,357,757, all of which are incorporated herein by reference. Typically, an acoustical compressor operates in the following fashion: A gas is drawn into a pulse chamber, such as air from the atmosphere, compressed, and then discharged as a high-pressure gas. The gas is compressed by the compressor sweeping a localized region of electromagnetic, for example microwaves, laser, infrared, radio etc, or ultrasonic energy through the gas in the pulse chamber at the speed of sound. This sweeping of the pulse chamber creates and maintain a high-pressure acoustic pulse in the gas. These acoustical compressors have many advantages over conventional compressors. For example, they have no moving parts besides the valves, operate without oil, and are much smaller than comparable conventional compressors.

In one embodiment of the present invention the gas is provided from a gas source at a rate of from about 10 l/s to about 70 l/s, more preferably, about 20 l/s to about 42 l/s, even more preferably about 25 l/s to about 30 l/s. The gas flow rate is measure by a flow meter place in the internal space of the vessel close to where the gas enters the vessel containing the clothes.

In one embodiment of the present invention the gas contacts the fabric articles at a velocity of from about 1 m/s to about 155 m/s, more preferably, about 50 m/s to about 105 m/s even more preferably about 75 m/s to about 105 m/s. The gas velocity is measure by a flow meter place in the internal space of the vessel close to where the gas enters the vessel containing the clothes.

The velocity at which the gas contacts the fabric articles and the flow rate of the gas are critical parameters. For example insufficient velocity, means that the particulates are not removed from the fabric articles. Too great a velocity and the fabric articles are disrupted such that the fabric articles cannot be agitated and the particulate soils cannot be removed. Similarly, insufficient flow rate of the gas means that any particulate soils removed remain and can be re-deposited on the fabric article after cleaning.

E. Applying Finishing Agent-Contacting Composition

In accordance with the present invention, a finishing agent-containing composition may be applied to the fabric articles.

It is desirable that the application of the finishing agent-containing composition to the fabric articles occurs after the mechanical removal step. Further, it is desirable that the application of the finishing agent-containing composition occurs prior to any evaporative removal step. The purpose of the finishing agent-containing composition is to apply a finishing agent to the fabric articles such that the finishing agent remains on the fabric articles after the method of the present invention.

The finishing agent-containing composition may be applied to the fabric articles at any amount. The quantity of finishing agent-containing composition applied to the fabric articles depends upon the type of fabric articles, the purpose of the finishing agent (i.e., sizing, perfuming, softening, deodorizing). Typically, a quantity of the finishing agent-containing composition of from about 0.1% to about 100%, more typically from about 0.5% to about 50%, most typically from about 1% to about 10% by dry weight of the fabric articles is applied to the fabric articles.

Depending upon the finishing agent and its purpose, the finishing agent-containing composition may be applied uniformly to the fabric articles.

The finishing agent-containing composition typically comprises a finishing agent selected from the group consisting of: fabric softening agents or actives, perfumes, hand-modifying agents, properfumes, fabric softening agents or actives, anti-static agents, sizing agents, optical brighteners, odor control agents, soil release polymers, hand-modifying agents, insect and/or moth repellent agents, antimicrobial agents, odor neutralizing agents and mixtures thereof.

The fabric softening agents or actives typically comprise a cationic moiety, more typically a quaternary ammonium salt, preferably selected from the group consisting of: N,N-dimethyl-N,N-di(tallowyloxyethyl) ammonium methylsulfate, N-methyl-N-hydroxyethyl-N,N-di (canoyloxyethyl) ammonium methylsulfate and mixtures thereof.

The hand-modifying agents typically comprise a polyethylene polymer.

One especially preferred finishing agent-containing composition comprises a mix of DPGDME (DiPropyleneGlycol DiMethylEther) N,N-di(tallowoyl-oxy-ethyl)-N,N-dimethyl ammonium chloride and a perfume.

F. Collecting Lipophilic Fluid

The lipophilic fluid removed from the fabric articles may be collected by any suitable means known to those in the art. The collected lipophilic fluid may be reused at a later time or may be stored until proper removal of the lipophilic fluid is arranged.

G. Reusing Lipophilic Fluid

The lipophilic fluid removed from the fabric articles may be reused. It is desirable that any soils present in the lipophilic fluid are removed prior to reapplying the lipophilic fluid to the fabric articles.

For the lipophilic fluid to be reused, it is desirable that the lipophilic fluid is processed to remove any soils as well as any water that are present in the lipophilic fluid. Nonlimiting examples of processing steps include filtering the lipophilic fluid, such as through an absorbent material, preferably an absorbent material that releasably captures water from the lipophilic fluid, other separation and/or filtering techniques, such as exposing the lipophilic fluid to an electric field.

What is claimed is:

1. A fabric treatment composition comprising:

(a) an effective mourn of a wrinkle control polymer comprising carboxylic acid moieties to control wrinkles in fabric;

(b) a co-solvent comprising water; and (c) from about 50% to about 99.99% by weight of the composition of a carrier comprising a lipophilic fluid.

2. The composition of claim 1 wherein the wrinkle control polymer is present at a level that is from about 0.001% to about 25% by weight of the composition.

3. The composition of claim 1 wherein the co-solvent is present at a level that is from about 0.001% to about 25% by weight of the composition.

4. The composition of claim 1 wherein the lipophilic fluid is selected from the group consisting of linear or cyclic siloxanes, fluorinated solvents, polyol polyesters, glycol others, and mixtures thereof.

5. The composition of claim 1 wherein the composition has a pH from about 3 to about 7 and a viscosity of less than about 20 cP.

6. The composition of claim 1 further comprising an additional ingredient selected from the group consisting of:

(i) a silicone compound, a silicone emulsion, or mixtures thereof;

(ii) a supplemental wrinkle control agent selected form the group consisting of (1) adjunct polymer free of carboxylic acid moieties, (2) fabric care polysaccharides, (3) lithium salts, (4) fiber lubricants, and (5) mixtures thereof;

(iii) a surface tension control agent;

(iv) a viscosity control agent;

(v) a hydrophilic plasticizer;

(vi) an odor control agent to absorb or reduce malodor;

(vii) a perfume to provide olfactory effects;

(viii) an antimicrobial active;

(ix) a buffer system and (x) mixtures thereof.

7. The composition of claim 1 further comprising an adjunct ingredient selected from the group consisting of bleaches, emulsifiers, fabric softener, antibacterial agents, brightens, dye fixatives, dye abrasion inhibitor, anti-crocking agents, toil release polymers, sunscreen agents, anti-fading agents, water-proofing agents, stain proofing agents, soil repellency agents, chelating agents, antistatic agents, insect and moth repelling agents, colorants, whiteness preservatives, and mixtures thereof.

8. The composition of claim 1 wherein the wrinkle control polymer is a homopolymer, a graft or block copolymer, or a cross-linked polymers comprising carboxylic monomers.

9. The composition of claim 1 wherein the wrinkle control polymer comprises carboxylic monomers selected from the group consisting of C1–C6 mono and poly-carboxylic acids, and mixtures thereof.

10. The composition of claim 9 wherein the wrinkle control polymer comprises carboxylic monomers selected from the group consisting of acrylic acid, methacrylic acid, crotonic acid, maleic acid and its half esters, itaconic acid adipic acid, and mixtures thereof.

11. The composition of claim 10 wherein the wrinkle control polymer comprises eaters of said acids with C1–C12 alcohols.

12. A method for treating fabrics comprising the steps of:

(a) applying a fabric treatment composition according to claim 1;

(b) applying a fabric cleaning composition comprising a lipophilic fluid;

(c) removing at least a portion of the fabric treatment composition; and (d) optionally, evaporatively removing at least a portion of the lipophilic fluid.

13. The method according to claim 12 wherein the fabric treatment composition is applied in an amount of from about 20% by dry weight of the fabrics to absorptive capacity of the fabrics.

14. The method according to claim 12 wherein total amount of the fabric treatment composition applied in one treatment cycle is from about 10% to about 1500% by dry weight of the fabrics.

15. The method according to claim 12 wherein the fabric treatment composition is applied by spraying, dipping, brushing on, or rubbing on.

16. The method according to claim 15 wherein the fabric treatment composition is applied by spraying in the form of droplets having a mean diameter of from about 50 to about 1000 microns.

* * * * *

UNITED STATES PATENT AND TRADEMARK OFFICE

CERTIFICATE OF CORRECTION

PATENT NO. : 6,746,617 B2
DATED : June 8, 2004
INVENTOR(S) : Radomyselski et al.

It is certified that error appears in the above-identified patent and that said Letters Patent is hereby corrected as shown below:

Column 25,
Line 22, please replace “mourn” with -- amount --.

Column 26,
Line 7, please replace “softener” with -- softeners --.
Line 8, please replace “brightens” with -- brighteners --.
Line 8, please replace “inhibitor” with -- inhibitors --.
Line 9, please replace “toil” with -- soil --.

Signed and Sealed this

Eleventh Day of October , 2005

JON W. DUDAS
*Director of the United States Patent and Trademark Office*